United States Patent [19]

Fernandes

[11] 4,069,024

[45] Jan. 17, 1978

[54] TWO-STAGE GASIFICATION SYSTEM

[75] Inventor: John Henry Fernandes, Windsor, Conn.

[73] Assignee: Combustion Engineering, Inc., Windsor, Conn.

[21] Appl. No.: 794,777

[22] Filed: May 9, 1977

[51] Int. Cl.[2] ..... C10J 3/08

[52] U.S. Cl. ..... 48/197 R; 48/202; 201/31

[58] Field of Search ..... 48/197 R, 202, 206, 48/210; 201/4, 31, 36, 37

[56] References Cited

U.S. PATENT DOCUMENTS

| | | | |
|---|---|---|---|
| 2,657,124 | 10/1953 | Gaucher | 48/197 R |
| 3,136,705 | 6/1964 | Sommers | 201/31 |
| 3,782,913 | 1/1974 | Donath | 48/210 |
| 3,847,563 | 11/1974 | Archer et al. | 48/206 |
| 3,920,417 | 11/1975 | Fernandes | 48/197 R |
| 3,981,690 | 9/1976 | Chen et al. | 201/31 |

*Primary Examiner*—S. Leon Bashore
*Assistant Examiner*—Peter F. Kratz
*Attorney, Agent, or Firm*—Wayne H. Lang

[57] ABSTRACT

A two-stage coal gasification system in which high temperature synthesis gas produced in a downflowing gasifier containing a high quantity of sensible heat is subsequently reacted in a pyrolyzing reactor with a charge of carbonaceous material and limestone at a reduced temperature to utilize the sensible heat contained in the gas and simultaneously produce an increase in the hydrocarbon content thereof.

13 Claims, 2 Drawing Figures

TWO-STAGE GASIFICATION SYSTEM

BACKGROUND OF THE INVENTION

Current environmental requirements dictate that coal and organic waste be burned to produce a gaseous or liquid derivative without the production of airborne sulphur oxides, nitrogen oxides, particulate matter, and without the problem of excessive residue ash. An obvious solution to this problem is to burn coal which itself contains a low content of sulphur, nitrogen, and particulate wastes. Such fuel is, however, in short supply and accordingly expensive, so only rarely can fuel with a desirable content be made available. More generally, a low grade coal or other carbonaceous material with a high content of particulate matter and sulphur is available.

A gas producing furnace utilizing low grade coal was shown and described in my previous U.S. Pat. No. 3,920,417 entitled, "Method of Gasifying Carbonaceous Material". In this patent a clean low BTU fuel gas was produced by reacting carbonaceous fuel with an oxidizer and steam in a fixed bed gasifier. The resulting reaction converted the carbonaceous fuel material to a molten slag and a gaseous effluent that was subsequently cooled and cleaned before it was directed to a place of use.

SUMMARY OF THE INVENTION

The present invention is concerned with a method and apparatus for directing a low BTU content synthesis gas, as produced in a fixed bed gasifier of the type previously disclosed, through a second stage having a serially interconnected pyrolyzer of unique "spouting bed" design wherein the hot synthesis gas from the gasifier is contacted by a hot carbonaceous charge and lime to utilize its high sensible heat to produce a cool, higher BTU product. Reactions take place between some of the carbon of the charge and hydrogen of the gas to increase the hydrocarbon content of the gas before it is conducted to its place of use, while the lime reacts with the sulphur to reduce if not eliminate the sulphur content of the gas. The remaining charge of char is devolatilized and passed on to the gasifier where a hot oxidizer and steam are added thereto to produce more synthesis gas that is supplied back to the pyrolyzer for reaction with the carbonaceous charge and lime.

The lime is introduced into the system as crushed limestone in advance of the pyrolyzing stage. Along with the limestone, a charge of raw carbonaceous material is introduced to react with the upflowing gas in the pyrolyzer. As the charge of raw material moves downward through the pyrolyzer, the calcium of the limestone reacts with any sulphur contained in the gas to form sulphur compounds which are subsequently removed with the residual char at the bottom of the pyrolyzer before being transferred to the gasifier. When the carbonaceous material is devolatilized in the "spouting bed" of the pryolyzer, the hydrocarbons given off react with the hydrogen of the gas to enrich the gas with methane and hydrogenated carbon. Subsequently the enriched gas passes out of the pyrolyzer to a dust separator where fine particulate matter is removed therefrom. From there the gas flows into one or more heat exchangers where the temperature of the gas is further reduced before it flows on a charge dryer where an initial heating is imparted to the charge of limestone and hydrocarbon being supplied to the pyrolyzer. The product gas is then imparted an additional stage of scrubbing and acid removal before it is exhausted as a clean product gas ready for use.

Although adapted for normal operation at atmospheric pressures, the entire system may be pressurized as desired to provide an optimum of hydrogenation, oil production or other reaction deemed essential to the operation of the system.

DESCRIPTION OF THE PREFERRED EMBODIMENT

Figure 1:
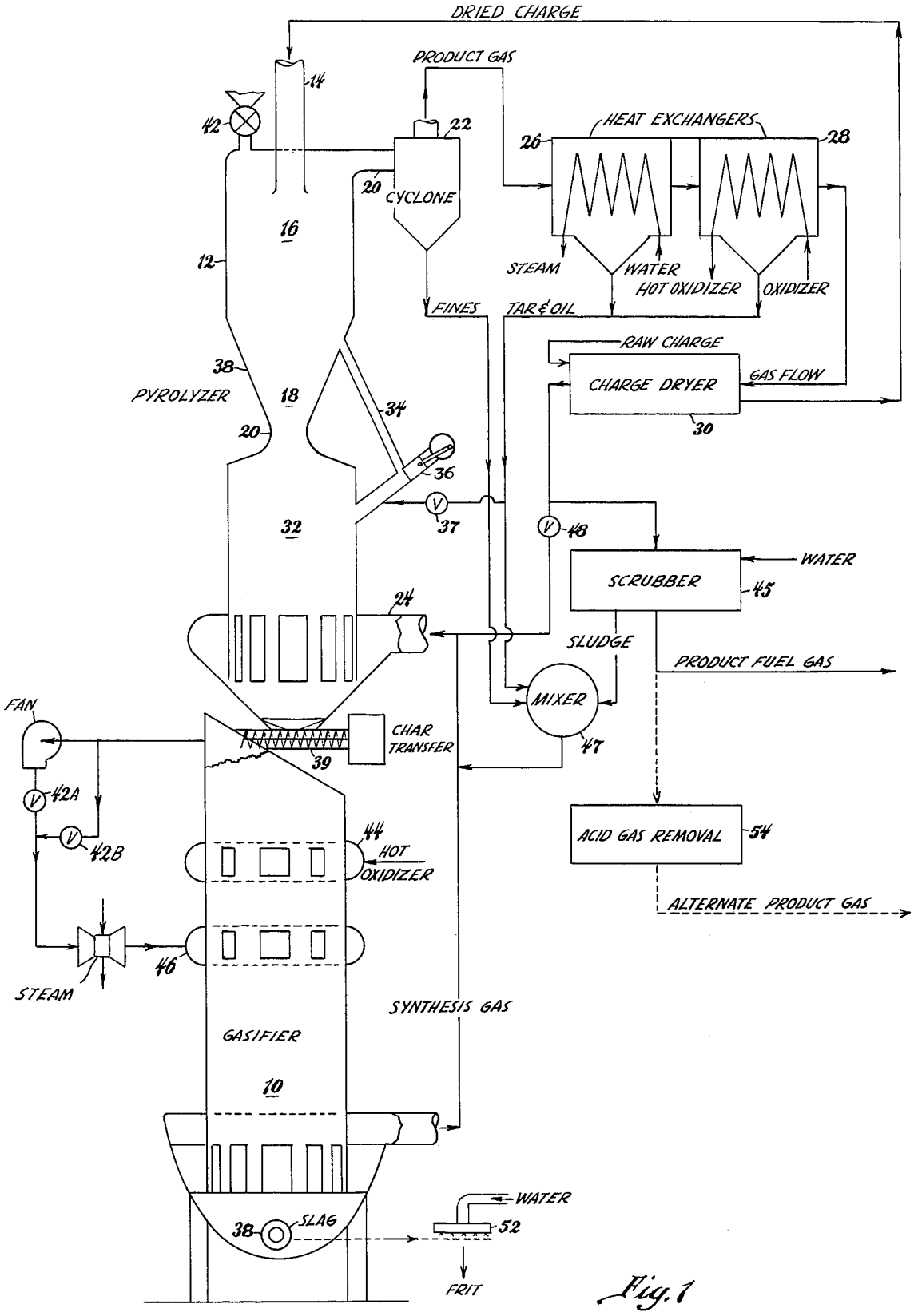
FIG. 1 is a schematic drawing showing a coal configuration system in which synthesis gas from a gasifier is further pyrolyzed in accordance with this invention.

In operation a pyrolyzing reactor 12 is adapted to receive a dried charge containing a hydrocarbon and limestone at the top inlet 14 where it falls through a disengaging chamber 16 to a section 18 having a reduced cross section that devolatilizes the inlet charge so that caking coals which might agglomerate and cause clinkering problems are handled without complications. During the fall of the charge through section 16, initial heating thereof by means of contact with a synthesis gas from the gasifier 10 produces methane and other hydrocarbons by rapid pyrolysis of the charge. Volatile fractions of the carbonaceous charge vaporize to substantially increase the BTU content of the gas ascending through the pyrolyzer and being exhausted therefrom. Flash hydrogenation of the carbonaceous material will also occur to produce an even higher BTU content of the product gas. Fine particles of carbonaceous material are carbonized and entrained in the product gas being exhausted from the pyrolyzer through an outlet 20 and then directed to a dust collector 22 where they are removed from the product gas. The particulate matter removed by collector 22 is re-introduced to the bottom of the pyrolyzer with the synthesis gas from the gasifier after being collected with other solid wastes in a mixer 47.

The essentially clean gas leaves dust collector 22 and flows through one or more heat exchangers 26 and 28 that produce steam for the gasifier and supply heat to an oxidizer such as air for use in the gasification process. The much cooled gas then flows through a kiln type dryer 30 in heat exchange relation with the raw limestone and the carbonaceous material being used as the raw charge material in the pyrolyzer to impart an initial heating thereto.

It has been found that the provision of a particularly restricted housing at throat 20 will provide a section 18 that imparts an increased velocity to the synthesis gas moving upward therethrough to produce what is known as a "spouting bed" type reactor. As the rising flow of gases meets the incoming charge of raw materials falling down from inlet 14 above the "spouting bed", the descending raw material is at first slowed down, then propelled upward and outward, causing circulation thereof together with increased reaction between the solids and the gas. "Hydrogenation reactions take place between the synthesis gas and the carbon and hydrogen of the charge to increase the hydrocarbon content of the product gas. That portion of the carbonaceous charge material not vaporized is heated to about 1500° F by the time it descends to the bottom of the pyrolyzer, while hot synthesis gas rising therethrough leaves the top of the pyrolyzer 12 at less than 1300° F, or between 1200° F to 1300° F, preferably about 1250° F to insure the vaporization of volatile matter contained in the char and in the reducing gas but to avoid uncontrolled agglomeration. The relatively large cross section of the disengaging chamber 16 causes all but the finest particles to drop back for further circulation by the spouting action of the gas moving up through throat 20. Some of the charge material with caking characteristics agglomerates and slides down along the sides of the housing walls before it drops through throat 20 into the lower chamber 32. However, particulate matter collecting on the sloping wall at the bottom of section 18 is drawn off through a chute 34 at the side thereof and supplied to the reactor section 32 of the pyrolyzer by a ram feeder 36 that compresses the charge into briquettes or blocks. A quantity of tarry substance condensed from the product gas by heat exchangers 26–28 is introduced into the ram feeder by valve 37 to serve as a binder for the char before it is introduced into the pyrolyzer.

Figure 2:
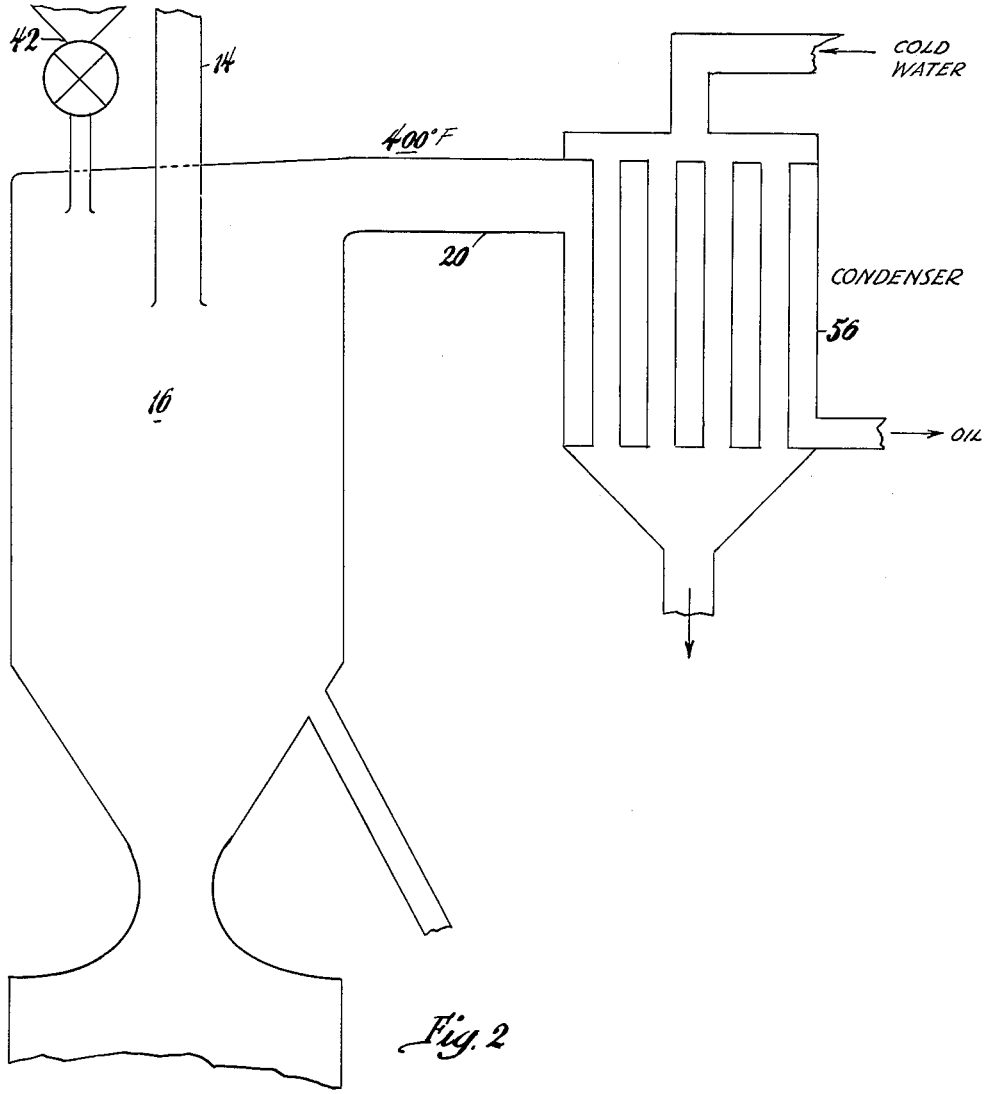
FIG. 2 is a schematic drawing that shows the coal gasification system modified to produce a liquid end product.

The briquettes thus formed in the briquetting device 36 comprise char mixed together with a binder of tar from heat exchangers 26–28 or other tar trap such as the condenser 56 of FIG. 2. As these blocks are introduced into the bottom portion 32 of the pyrolyzer they react with the heat therein to produce a hard block of char that possesses sufficient structural strength to form a non-blinding matrix permeable to the gas, and adapted to enhance its contacting relationship therewith.

The chute 34 and the ram feeder 36 preclude excessive particle build-up on the charge bed itself, but they also insure positive control of the residence time and bed height to maintain optimum gasification. The chute 34 and feeder 36 should be suitably insulated with a refractory type insulation to prevent heat loss from the material passing therethrough while it is removed from the hot gas of the pyrolyzer.

The housing forming the "spouting bed" section for the dilute phase of the pyrolyzer has walls 38 that diverge gradually to chamber 16 on the upper side of throat 20, while the walls flare abruptly outward beneath throat 20 to form chamber 32. It should be understood that this section need not be circular in cross section although it has been found that optimum operation can be experienced with apparatus having a distance across walls 32 not exceeding 12 feet. This width is dependent upon the depth of flow penetration of the bed possible in both the pyrolyzer and the gasifier. However, the length of the cross section would be determined by the desired gas production capacity.

Some hydrogenation takes place in the pyrolyzer whenever the hot synthesis gas from gasifier 10 is directed upward through a charge of carbonaceous material and limestone. However, it is possible to increase the hydrogenation of the synthesis gas by the addition of light, hollow spheres made from or coated with a suitable catalyst and added to the disengaging chamber 16 by a feeder 42. The density of the spherical catalyst members is such that they are repeatedly circulated in chamber 16 above throat 20 by the "spouting bed" causing intimate contact between the synthesis gas and the charge, thus promoting increased hydrogenation and enrichment of the synthesis (product) gas. After extended use attrition will cause some of the catalytic spheres to be carried out the gas outlet 20 to the cyclone 22 where they may be removed and collected for reprocessing.

The transfer chute 34 removes the charge material collecting on inclined walls 38 where the light catalytic spheres are not to be found because they are too light to settle out. However, if they should break and mix with the charge they would melt and eventually come out of the gasifier as a part of the slag.

The carbonaceous charge material leaves the pyrolyzer by means of a transfer unit 39 as a char at approximately 1500° F, well below its softening temperature. Inasmuch as the char material is not plastic, it may again be subjected to a conventional pelletizing or briquetting stage intermediate the pyrolyzer and gasifier as required to densify the char and insure sufficient matrix strength as it flows through the gasifier.

As the char material descends through the gasifier, the hot oxidizer and steam provided by heat exchangers 26 and 28 are introduced into the gasifier at 44 and 46 to react with the molten slag at a temperature just above the fusion temperature of the slag. A critical temperature above the fusion temperature is selected in order that the slag may be maintained as a plastic medium that flows freely from a suitably located tap 38 at the bottom of the gasifier.

A portion of the synthesis gas is withdrawn from the upper end of the gasifier 10 and directed through a by-pass line and valve 42B before it is re-introduced into the gasifier 10 through manifold 46. The gas is drawn along by a quantity of superheated steam from heat exchanger 26 exhausting through the aspirator. Under normal operating conditions the aspirator acts to draw sufficient hot gas from the upper end of the gasifier to maintain and position an ignition zone centrally within the gasifier 10. When hot material is being introduced into gasifier 10 from pyrolyzer 32 at about 1500° F, very little recirculation is needed to maintain and position the ignition zone in the gasifier 10. However, under certain conditions such as a cold start, it may be necessary to supplement the action of the aspirator by the use of a circulating fan and valve 42A connected in parallel with the valve 42B.

On its flow downward through the gasifier, the slag and limestone are liquefied so that the liquefied slag will capture any sulphur remaining in the reaction. The sulphur may then be removed with the slag as calcium sulphide, and only substantially sulphur-free gas then is exhausted as a synthesis gas to be directed to the pyrolyzer. Subjecting the molten slag from tap 38 to a cool water bath at 52 will produce solidification of the slag in the form of a granular frit having various commercial uses.

As the hot synthesis gas rises through the pyrolyzer section 32, the synthesis gas (a reducing gas) heats the charge while preventing oxidation of sulphur to $SO_2$ within the gas stream. Furthermore, the sensible heat content thereof is sufficient to react with the limestone and hydrocarbon to capture much of the sulphur in the gas and enhance its hydrocarbon content before it is exhausted to upper chamber 16 and to the dust collector 22.

After the hot product gas has traversed dust collector 22, heat exchangers 26 and 28, and kiln dryer 30, it is directed through a scrubber 45 before it is dispensed with as a finished product gas. Fines from the dust collector, together with tar and oil condensed out of the product gas when traversing the heat exchangers 26 and 28, and sludge from scrubber 45 are mixed together in mixer 47 and then directed back into the synthesis gas before being admitted to the pyrolyzer where they are again subjected to pyrolysis. After traversing the scrubber 45 the product gas may be used as desired, or it may be subjected to yet another step in the removal of acid gas or other impurities as shown at 54.

The temperature of the reaction within the pyrolyzer 12 is controlled by the regulation of valve 48 which determines the amount of cool product gas permitted to mix with the hot synthesis gas (2000° F to 2500° F) from the gasifier 10 being directed back into the pyrolyzer. The normal temperature of the hot synthesis gas being admitted to the pyrolyzer at inlet 24 deemed necessary to produce a gaseous end product ranges from 1500° F to 1800° F. For effective operation this temperature should be maintained as high as possible to promote non-catalytic methanation of the pyrolyzer carbon and the hydrogen in the gas. While a maximum temperature is desired, the temperature should always be kept below the softening temperature of the contacting char whereby said char may be transferred to the gasifier as a solid. As above mentioned, this temperature is controlled by recycling gas from ahead of the scrubber back to the pyrolyzer inlet 20 through the control valve 48. By recirculating an additional amount of cool product gas, the temperature of the product gas at the outlet 20 may be reduced to about 400° F where there will be much less cracking of the long chain hydrocarbons in the fluid bed and a substantial increase in their production in the form of oils and tars.

Therefore, if a liquid end product (oil) is desired instead of a product gas, a condenser 56 would replace the dust collector 22 and heat exchangers 26 and 28 in the manner shown by FIG. 2 of the drawing, and an increased amount of product gas would be recirculated through valve 48 to lower the reaction temperature within the pyrolyzer to approximately 1500° F whereby the outlet gas temperature at 20 would not exceed 400° F, and the outlet product gas could readily be condensed to a liquid containing oil and tar in condenser 56 by indirect contact with a cool fluid such as water.

I claim:

1. A method of producing a fuel gas from a carbonaceous material which comprises the steps of:

a. providing an upright gasifier with an oxidation zone intermediate a preheating zone and a subjacent reducing zone, b. introducing devolatilized carbonaceous material and limestone to said preheating zone of the gasifier, c. oxidizing the carbonaceous material to form a gaseous product, a char containing carbon, and a molten slag, d. reacting said gaseous product with steam and carbon from said char to form a hot reducing type synthesis gas, e. providing a vertical shaft pyrolyzing furnace having a "restricted throat" section intermediate a disengaging section and a subjacent reaction section, f. introducing the hot synthesis gas from the bottom of the gasifier to the bottom portion of the pyrolyzing furnace in the reaction thereof, g. introducing a charge of carbonaceous material and limestone to the top of the pyrolyzing furnace in the disengaging section thereof, h. maintaining an upward flow of said hot synthesis gas through the pyrolyzing furnace in opposition to the descending flow of carbonaceous material and limestone whereby said carbonaceous material is heated and partially volatilized to permit the volatile constituents thereof to combine with the synthesis gas passing therethrough to increase the hydrocarbon content thereof before it is exhausted as a final product gas said restricted throat section being formed so as to cause the descending carbonaceous material to be slowed down at first, and then be propelled upward and outward thereby causing circulation of the carbonaceous material in the form of a spouting bed, i. and transferring devolatilized carbonaceous material and limestone from the bottom of the pyrolyzing furnace to the gasifier as feedstock for the gasifier according to step (b).

2. The method of claim 1 including the step of maintaining the temperature of the devolatilized carbonaceous material being transferred from the pyrolyzer to the gasifier at a temperature that does not exceed the fusion temperature of such material.

3. The method of claim 1 including the step of maintaining the temperature of the synthesis gas exhausting from the gasifier at from 2000° F to 2500° F.

4. The method of claim 3 including the step of maintaining the temperature of the synthesis gas being directed into the pyrolyzer furnace by the admixture of a quantity of cooled product gas exhausting from the pyrolyzing furnace.

5. The method of claim 4 including the step of maintaining the temperature of the product gas exhausting from the pyrolyzer from 1200° F to 1300° F to insure the vaporization of volatile matter contained in the char and in the reducing gas but to avoid uncontrolled agglomeration.

6. The method as defined in claim 5 wherein the charge of carbonaceous material and limestone added into the pyrolyzer furnace first traverses a free falling disengaging zone where said charge is flash heated before it descends to a restricted throat section that retards flow therethrough and provides prolonged heating thereof.

7. The method of claim 1 including cooling the product gas by directing it in heat exchange relation with the carbonaceous material and limestone being directed into the pyrolyzing furnace, and tempering the synthesis gas with cool product gas prior to its entry into the bottom of the pyrolyzer whereby the temperature of the product gas exhausting from the pyrolyzer does not exceed about 1300° F.

8. The method of claim 7 including passing the product gas exhausting from the pyrolyzer through cleaning apparatus that removes particulate matter therefrom, and directing said particulate matter into the synthesis gas in advance of said pyrolyzer.

9. The method of claim 1 including passing said gas mixture through condensing apparatus in heat exchange relation with a cooler fluid to remove tarry liquids therefrom.

10. The method of claim 9 including the step of adding tarry liquids condensed from the product gas to the carbonaceous material and limestone passing from the pyrolyzer to the gasifier.

11. The method of claim 1 including the step of bypassing a portion of the char descending through the pyrolyzing furnace around the throat therein whereby it will be moved from the disengaging section to the reaction section.

12. The method of claim 11 including the step of compressing the char by-passing the throat section of the pyrolyzing furnace to form a high density cake of char before it is introduced into the reaction section of the pyrolyzing furnace.

13. The method of claim 12 including the step of adding tarry liquids removed from the product gas to the char being bypassed around said throat to provide a bonding agent therefor.

* * * * *